US006129703A

United States Patent [19]

Beneke

[11] Patent Number: 6,129,703

[45] Date of Patent: Oct. 10, 2000

[54] APPARATUS FOR FEEDING PRETERM INFANTS

[75] Inventor: Craig A. Beneke, Dallas, Tex.

[73] Assignee: GroundZero Corporation, Addison, Tex.

[21] Appl. No.: 09/204,844

[22] Filed: Dec. 3, 1998

Related U.S. Application Data

[60] Provisional application No. 60/067,795, Dec. 3, 1997.

[51] Int. Cl.[7] ..... A61J 7/00

[52] U.S. Cl. ..... 604/77; 604/79

[58] Field of Search ..... 604/77–80, 257, 604/258, 259, 261, 262; 215/11.1; 248/123.2, 123.11, 124.1, 125.8, 125.9

[56] References Cited

U.S. PATENT DOCUMENTS

| | | | |
|---|---|---|---|
| 3,645,262 | 2/1972 | Harrigan . | |
| 3,982,716 | 9/1976 | Trees . | |
| 4,074,397 | 2/1978 | Rosin . | |
| 4,278,225 | 7/1981 | Phelps . | |
| 4,463,859 | 8/1984 | Greene | 215/11.1 |
| 4,541,596 | 9/1985 | Price | 248/125.8 X |
| 4,702,736 | 10/1987 | Kalt et al. . | |
| 4,787,591 | 11/1988 | Villacorta . | |
| 4,852,844 | 8/1989 | Villaveces . | |
| 5,049,127 | 9/1991 | Yen Tseng | 604/79 |
| 5,098,399 | 3/1992 | Tollini . | |
| 5,413,562 | 5/1995 | Swauger . | |
| 5,470,037 | 11/1995 | Willis | 248/125.9 |
| 5,549,567 | 8/1996 | Wolman . | |
| 5,676,137 | 10/1997 | Byrd . | |
| 5,769,368 | 6/1998 | Busey | 248/125.9 X |

*Primary Examiner*—A. T. Nguyen
*Attorney, Agent, or Firm*—Smith & Danamraj, P.C.

[57] ABSTRACT

An apparatus for holding and feeding a preterm infant comprising a neonatal bassinet that holds the infant in a position for feeding, a gavage syringe for holding and dispensing nutritional liquid through a catheter, and a Gavage Syringe Restraining Device (GSRD) attached to the bassinet. The GSRD is an L-shaped bracket which holds the gavage syringe in an elevated position above the infant. The GSRD comprises a vertical arm which holds the gavage syringe and a horizontal arm which is mounted to the inside bottom surface of the bassinet under a removable mattress. The vertical arm includes a plurality of vertical slits arranged in pairs. An adjustable strap is positioned through a selected pair of slits and is wrapped around the gavage syringe to hold the syringe in a selected position. The bassinet may be mounted on a mobile cart and moved without interrupting the feeding of the infant, and without having to remove the syringe from a fixed mounting location.

10 Claims, 4 Drawing Sheets

APPARATUS FOR FEEDING PRETERM INFANTS

This application claims the benefit of U.S. Provisional Application No. 60/067,795, filed on Dec. 3, 1997.

BACKGROUND OF THE INVENTION

1. Technical Field of the Invention

This present invention relates to the developmental care of preterm infants, and more particularly, to an apparatus for holding and feeding preterm infants.

2. Description of Related Art

Infants who are born several weeks early, are small, weak, and may not have developed the instinct of sucking. Therefore, these infants may be unable to feed themselves by nursing or taking a bottle. In order to feed these infants, neonatal intensive care units utilize a process known as "gavage", or gravity feeding. During gavage feeding, a nutritious liquid formula is placed in a syringe-like reservoir which is mounted at an elevated position above the infant. The infant may be in a bassinet or an isolette. In the description of the invention that follows, the term bassinet is utilized collectively to refer to a bassinet or an isolette. A long thin tube, or catheter, which is connected at one end to the lower end of the syringe, is inserted through the infant's nostril, down the infant's esophagus, and into the infant's stomach. The nutritious liquid formula then flows by gravity from the reservoir of the syringe, through the catheter, and into the infant's stomach.

There has long been a problem, however, associated with mounting the gavage syringe in its elevated position above the infant. Often, gavage syringes are taped to surrounding walls, to the sides of isolettes, or to nearby glass windows. Alternatively, a rolling I.V. stand may be placed near the infants bassinet where it is utilized to hold the gavage syringe in its elevated position. All of these methods of mounting the gavage syringe, however, have serious disadvantages. First, if tape is utilized, there is the danger that the tape will come lose, and the syringe will fall from its elevated position. Second, when the syringe is mounted to an object other than the infant's bassinet, the catheter tubing which runs from the syringe to the infant must extend across an area where the tubing presents a hazard. When a rolling I.V. stand is utilized, the proximity of the stand to the infant's bassinet may cause care personnel to trip over the legs of the I.V. stand, or the stand or the catheter tubing may otherwise impede their ability to perform emergency care actions. Third, when the syringe is mounted to an object other than the infant's bassinet, the bassinet cannot be moved without unmounting the syringe and carrying it, or moving the object to which the syringe is mounted.

Although there are no known prior art teachings of a solution to the aforementioned deficiency and shortcoming such as that disclosed herein, U.S. Pat. No. 5,470,037 to Willis (Willis) discusses subject matter that bears some relation to matters discussed herein. Willis discloses an apparatus for self-administering fluids to patients, children, and persons of limited capabilities. FIGS. 6 and 7 of Willis show an embodiment of the apparatus which is suitable for mounting the apparatus to a support structure such as a crib. However, the apparatus of Willis is entirely unsuitable for use with the small bassinets and isolettes utilized in neonatal intensive care units. Thus, a review of Willis reveals no disclosure or suggestion of an apparatus such as that described and claimed herein.

In order to overcome the disadvantage of existing solutions, it would be advantageous to have an apparatus for mounting a gavage syringe which compatibly mounts with the small bassinets utilized in neonatal intensive care units. Such an apparatus would hold the gavage syringe at the correct height for proper gavage feeding, and would enable the bassinet to be moved without interrupting the feeding of the infant, and without having to remove the syringe from a fixed mounting location. The present invention provides such an apparatus.

SUMMARY OF THE INVENTION

In one aspect, the present invention is an apparatus for holding and feeding a preterm infant. The apparatus comprises a neonatal bassinet that holds the infant in a position for feeding, a gavage syringe for holding and dispensing nutritional liquid through a catheter, and a Gavage Syringe Restraining Device (GSRD) attached to the bassinet. The GSRD holds the gavage syringe in an elevated position above the infant. The bassinet may be mounted on a mobile cart and moved without interrupting the feeding of the infant, and without having to remove the syringe from a fixed mounting location.

In another aspect, the present invention is a Gavage Syringe Restraining Device (GSRD) for holding a gavage syringe containing nutritional liquid in an elevated position above an infant lying in a bassinet having a side wall, an inside bottom surface, and a removable mattress. The GSRD comprises a vertical arm and a horizontal arm connected to the vertical arm. The vertical arm includes a plurality of vertical slits arranged in pairs. An adjustable strap is positioned through a pair of slits and is wrapped around the gavage syringe to hold the syringe in a selected position. The horizontal arm is mounted to the inside bottom surface of the bassinet under the removable mattress.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
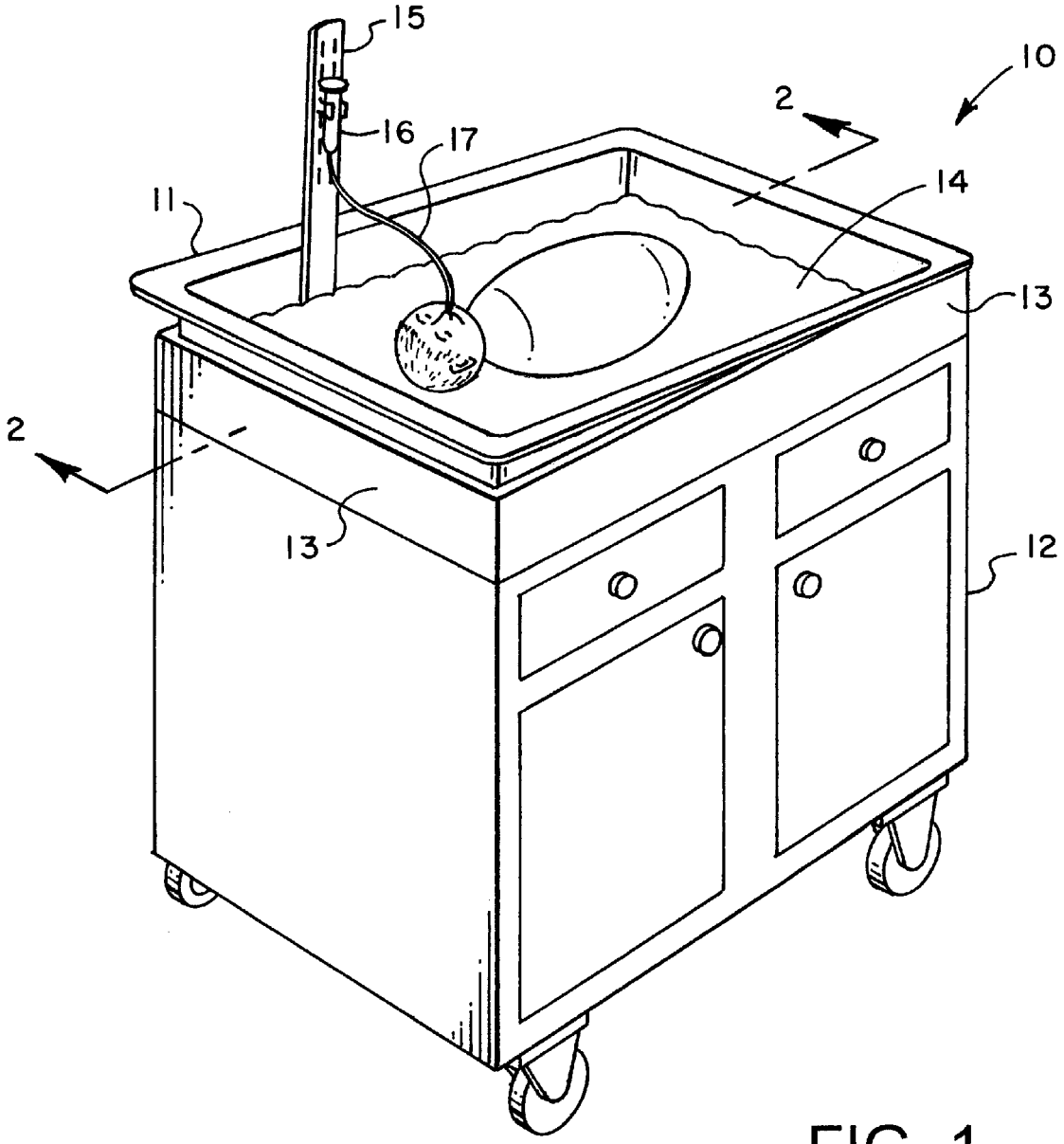
FIG. 1 is a perspective view of the holding and feeding apparatus of the present invention.

FIG. 1 is a perspective view of the holding and feeding apparatus 10 of the present invention. A bassinet 11, which may be constructed of plexiglass, plastic, or other suitable material is mounted on a mobile cart 12. The bassinet is mounted at an angle so that the infant's head is slightly elevated. In the preferred embodiment, the bassinet is mounted within side rails 13 of the mobile cart. The infant lies upon a removable mattress 14 which is placed in the bottom of the bassinet. A Gavage Syringe Restraining Device (GSRD) 15 is mounted on the bassinet. The GSRD holds a gavage syringe 16 in an elevated position above the infant. Nutritional liquid in the syringe is gravity-fed through a catheter 17. The catheter is inserted through the infant's nostril, down the infant's esophagus, and into the infant's stomach.

Figure 2:
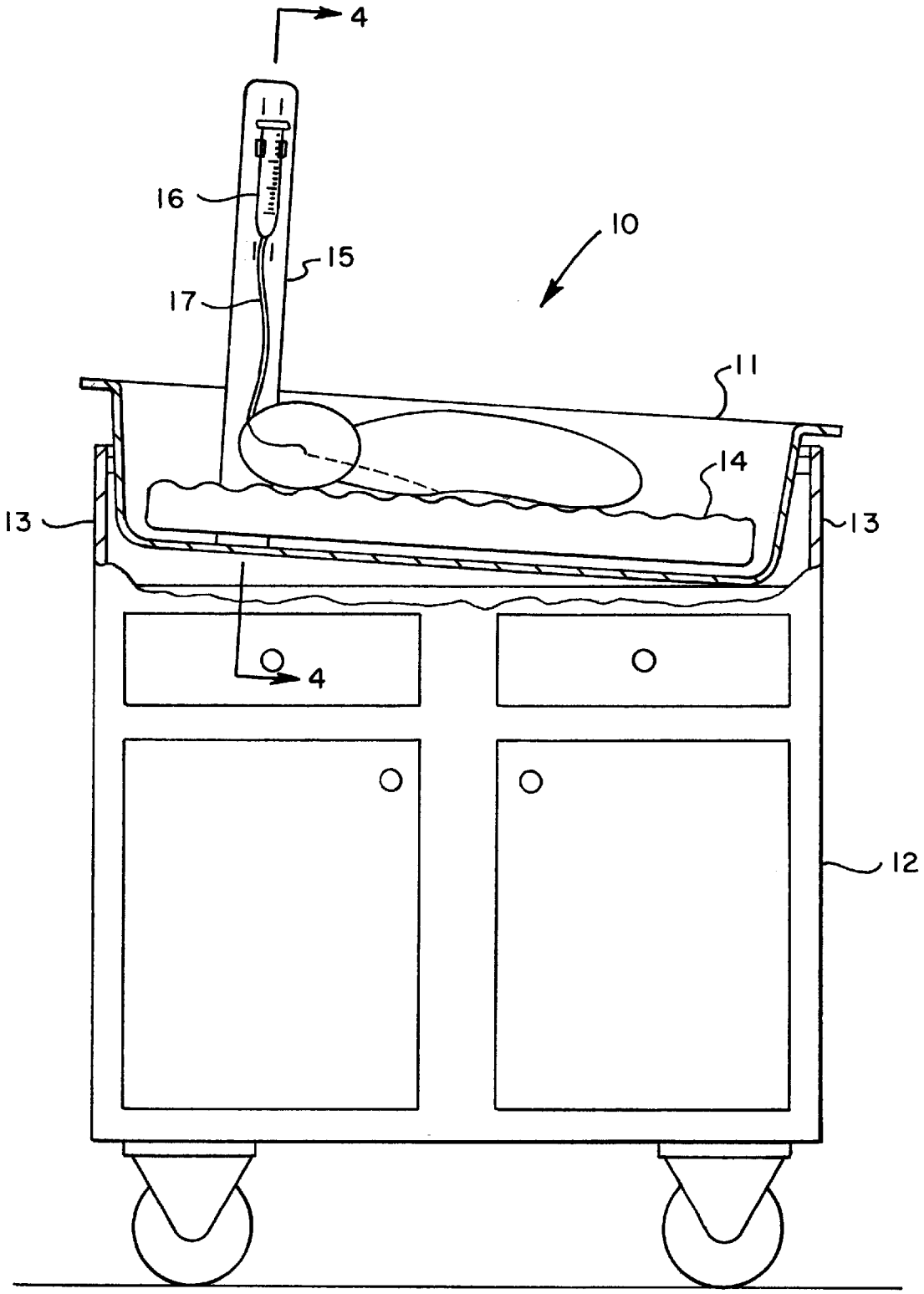
FIG. 2 is a partial cross-sectional front view of the apparatus of FIG. 1 with a cross-section taken of the bassinet along line 2—2.

FIG. 2 is a partial cross-sectional view of the apparatus of FIG. 1 taken along line 2—2. It can be seen that the bassinet 11 is mounted within the side rails 13 at a slight angle in order to raise the head of the infant for proper feeding. In addition, it can be seen that the GSRD 15 extends down the side of the mattress 14 and mounts to the bassinet under the mattress. This is shown in more detail in FIG. 4.

Figure 3:
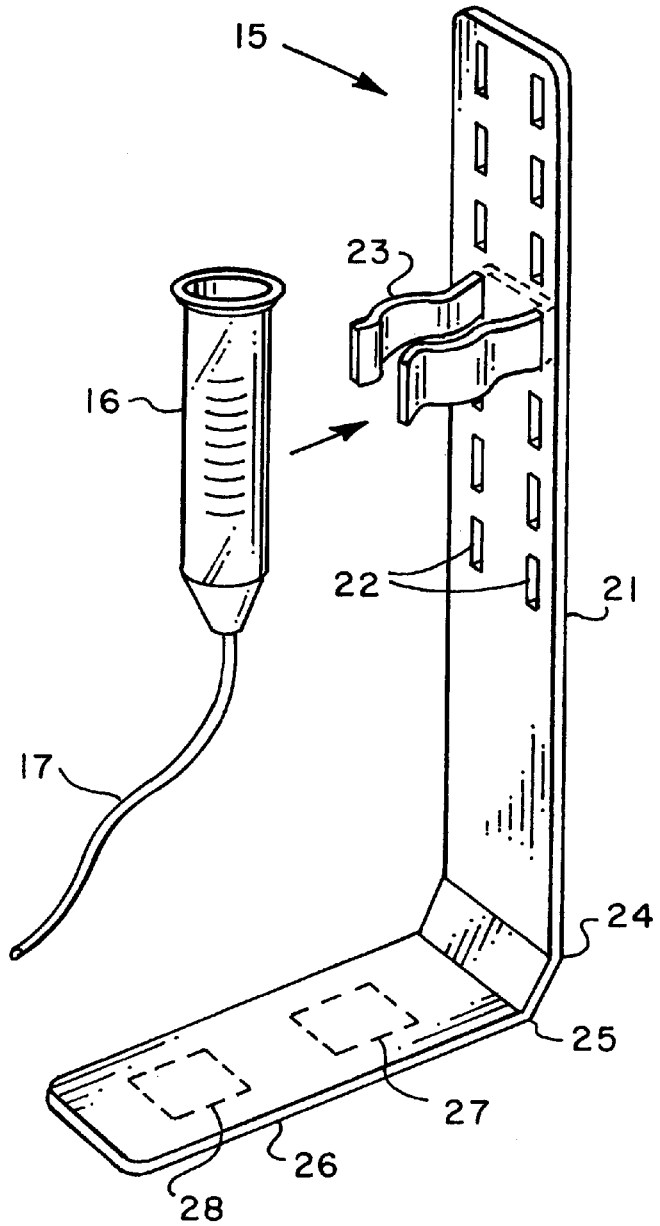
FIG. 3 is a perspective view of the L-shaped Gavage Syringe Restraining Device (GSRD)

FIG. 3 is a perspective view of the GSRD 15. The GSRD is essentially an L-shaped bracket which mounts to the bottom of the bassinet 11. The GSRD is preferably constructed of 16-gauge, #3 finish stainless steel. However, other rigid materials such as plastic or plexiglass may also be utilized without departing from the scope of the present invention. Preferably, the material utilized should have a smooth surface for easier cleaning. A vertical arm 21 of the GSRD extends approximately 22½ inches above the inside bottom surface of the bassinet. When utilized with an isolette, the vertical arm is reduced in height to approximately 14 inches.

Beginning at the top of the vertical arm, a plurality of pairs of small vertical slits 22 approximately 1-inch in height are placed every ½ inch of the vertical arm. In the preferred embodiment, a 1-inch wide hook and pile (e.g., Velcro) strap 23 is placed through a pair of the slits from the back of the vertical arm at the height where it is desired to restrain the gavage syringe 16. The hook and pile strap is wrapped tightly around the syringe, and the hook and pile sections of the strap are engaged to hold the syringe.

In the preferred embodiment, the GSRD has two 45° bends 24 and 25 rather than one 90° bend between the vertical arm 21 and a horizontal arm 26. The two 45° bends provide added strength and rigidity, and enable the GSRD to conform to the curvature of the inside corner of the bassinet where the bottom meets the side wall. The GSRD may also be formed with a quarter-circular arc having a radius of curvature which approximates the curvature of the corner of the inside surface of the bassinet.

The horizontal arm 26 extends approximately 10 inches from the lower 45° bend 25. The horizontal arm is mounted to the inside bottom surface of the bassinet 11. In the preferred embodiment, two Velcro pads 27 and 28 (shown in phantom) are attached to the bottom of the horizontal arm. Corresponding pads (not shown) are attached to the inside bottom surface of the bassinet. The pads may be attached to the GSRD and the bassinet with a strong adhesive. Obviously, if hook pads are attached to the GSRD, then pile pads are attached to the bassinet, and vice versa.

Figure 4:
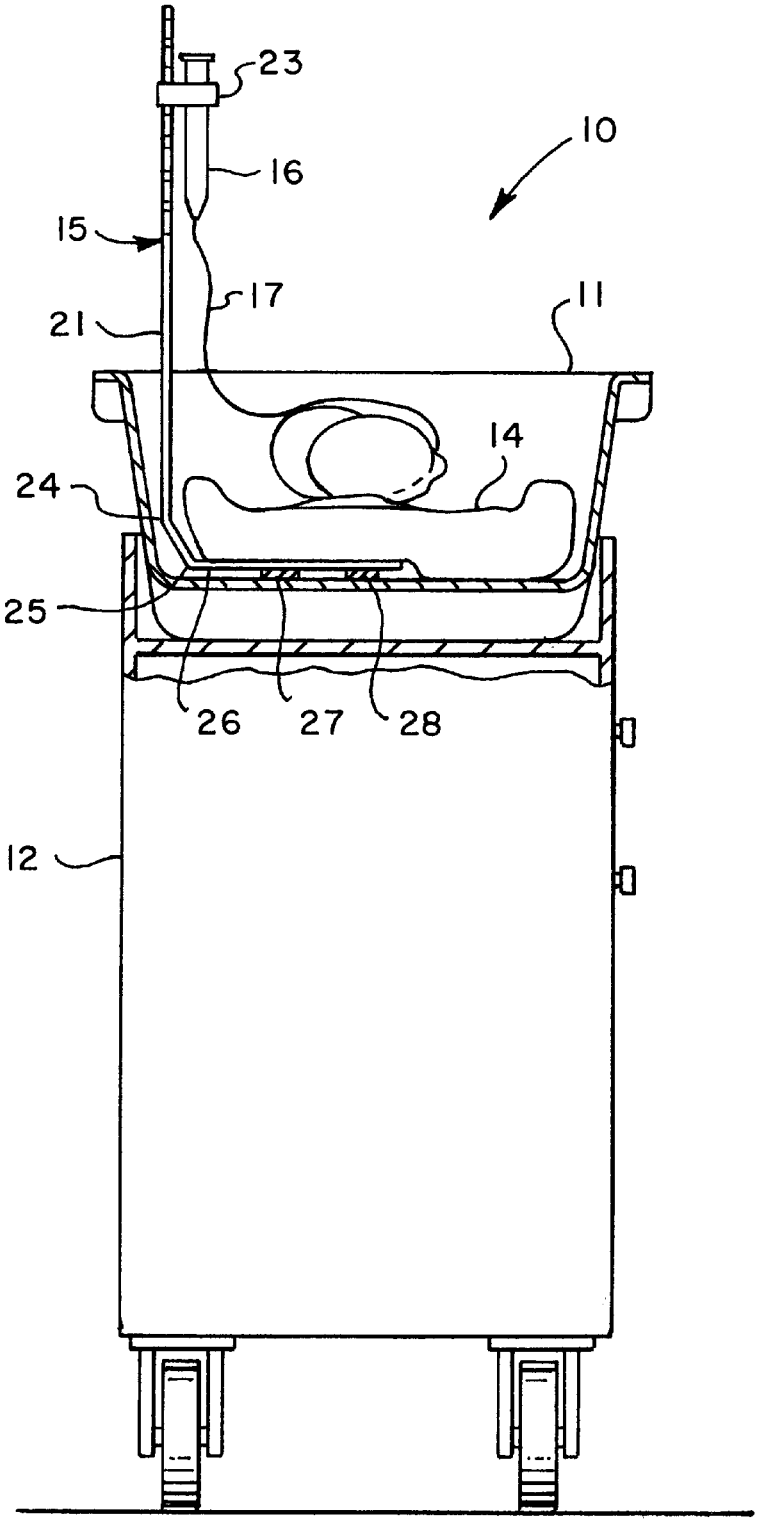
FIG. 4 is a partial cross-sectional side view of the apparatus of FIG. 2 with a cross-section taken of the bassinet along line 4—4.

FIG. 4 is a partial cross-sectional view of the apparatus of FIG. 2 taken along line 4—4. This view illustrates the two 45° bends 24 and 25, and shows an exemplary positioning of the Velcro pads 27 and 28 on the bottom of the horizontal arm 26. After mounting the GSRD to the inside bottom surface of the bassinet, the removable mattress 14 is placed in the bassinet, covering the horizontal arm 26 of the GSRD. The infant is then placed upon the mattress and prepared for feeding by inserting the catheter 17.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. An apparatus for holding and feeding a preterm infant comprising:

a mobile cart;

a neonatal bassinet mounted on top of the mobile cart, said bassinet having an inside bottom surface, and holding the infant in a position for feeding;

a gavage syringe for holding and dispensing nutritional liquid through a catheter; and an L-shaped Gavage Syringe Restraining Device (GSRD) mounted to the inside bottom surface of the bassinet, said GSRD holding the gavage syringe in an elevated position above the infant.

2. The apparatus for holding and feeding a preterm infant of claim 1 wherein the GSRD includes:

a vertical arm, said vertical arm including means for holding the gavage syringe; and a horizontal arm connected to the vertical arm, said horizontal arm being mounted to the inside bottom surface of the bassinet.

3. The apparatus for holding and feeding a preterm infant of claim 2 wherein the means for holding the gavage syringe includes:

a plurality of slits in the vertical arm; and an adjustable strap positioned through two of the slits, said strap wrapping around the gavage syringe to hold the syringe in a selected position.

4. The apparatus for holding and feeding a preterm infant of claim 3 wherein the plurality of slits are arranged in vertical pairs, and the adjustable strap is positioned in a selected vertical pair of slits to hold the syringe in the selected position.

5. The apparatus for holding and feeding a preterm infant of claim 4 wherein the adjustable strap is a hook and pile strap.

6. The apparatus for holding and feeding a preterm infant of claim 5 wherein the inside bottom surface of the bassinet curves upward at the corner of a side wall, and the GSRD also includes a region between the vertical arm and the horizontal arm which conforms to the inside bottom surface of the bassinet.

7. The apparatus for holding and feeding a preterm infant of claim 6 wherein the region between the vertical arm and the horizontal arm includes a quarter-circular arc of the GSRD which conforms to the inside bottom surface of the bassinet.

8. The apparatus for holding and feeding a preterm infant of claim 6 wherein the region between the vertical arm and the horizontal arm includes two 45° bends of the GSRD.

9. In an apparatus for holding and feeding a preterm infant of the type having a mobile cart, a neonatal bassinet mounted on the cart for holding the infant in a position for feeding, said bassinet having an inside bottom surface, a gavage syringe for storing and dispensing nutritional liquid through a catheter, and means for holding the gavage syringe in a fixed location and at an elevated position above the infant, the improvement wherein the means for holding the gavage syringe includes a Gavage Syringe Restraining Device (GSRD) attached to the bassinet, thereby enabling the apparatus to be moved during gavage feeding of the infant, said GSRD including:

a vertical arm which holds the gavage syringe; and a horizontal arm connected to the vertical arm, said horizontal arm being mounted to the inside bottom surface of the bassinet.

10. The apparatus for holding and feeding a preterm infant of claim 9 wherein the vertical arm has at least one pair of vertical slits, and the GSRD further comprises an adjustable strap positioned through the slits, said strap wrapping around the gavage syringe to hold the syringe in a selected position.

* * * * *